US007815088B2

(12) United States Patent
Fielitz et al.

(10) Patent No.: US 7,815,088 B2
(45) Date of Patent: Oct. 19, 2010

(54) HAND-HELD DRIVE-IN TOOL

(75) Inventors: Harald Fielitz, Buchs (CH); Walter Odoni, Planken (LI); Robert Spasov, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 74 days.

(21) Appl. No.: 12/082,708

(22) Filed: Apr. 11, 2008

(65) Prior Publication Data

US 2008/0296339 A1 Dec. 4, 2008

(30) Foreign Application Priority Data

Apr. 13, 2007 (DE) ..... 10 2007 000 226

(51) Int. Cl.
*B25C 5/00* (2006.01)

(52) U.S. Cl. ..... 227/132; 227/129; 227/131

(58) Field of Classification Search ..... 227/129, 227/131, 132; 173/90
See application file for complete search history.

(56) References Cited

U.S. PATENT DOCUMENTS 4,085,337 A * 4/1978 Moeller ..... 307/115
4,200,213 A * 4/1980 Liesse ..... 227/10
5,004,140 A 4/1991 Fushiya
5,114,064 A * 5/1992 Jochum et al. ..... 227/9
5,802,691 A * 9/1998 Zoltaszek ..... 29/243.526
6,138,772 A * 10/2000 Miescher et al. ..... 173/93.5
7,275,673 B2 * 10/2007 Zahner et al. ..... 227/10
7,513,407 B1 * 4/2009 Chang ..... 227/132
7,537,146 B2 * 5/2009 Schiestl ..... 227/133
7,543,728 B2 * 6/2009 Spasov et al. ..... 227/132
7,694,863 B2 * 4/2010 Spasov et al. ..... 227/132
2007/0007319 A1 * 1/2007 Simonelli et al. ..... 227/131
2007/0251973 A1 * 11/2007 Bruggmuell et al. ..... 227/131

FOREIGN PATENT DOCUMENTS

DE 10 2005 000 843 A1 7/2006

* cited by examiner

*Primary Examiner*—Rinald I. Rada
*Assistant Examiner*—Gloria R. Weeks
(74) *Attorney, Agent, or Firm*—Abelman, Frayne & Schwab

(57) ABSTRACT

A hand-held drive-in tool for driving fastening elements in a workpiece and including a guide (12), a drive-in ram (13) displaceable in the guide (12) for driving a fastening element in, a drive-in unit (30) for driving the drive-in ram (13) and including at least one first drive spring (31) and at least one second drive spring (32) having respectively, opposite first and a second expansion directions (37, 38), and a tensioning device for preloading the drive-in ram (13) and the first drive spring (31).

13 Claims, 2 Drawing Sheets

HAND-HELD DRIVE-IN TOOL

BACKGROUND OF THE INVENTION

1. Field of the Invention

The present invention relates to a hand-held drive-in tool for driving fastening elements in a workpiece, comprising a guide, a drive-in ram displaceable in the guide for driving a fastening element in, a drive-in unit for driving the drive-in ram and including at least one or first drive spring having a first expansion direction, and a tensioning device for preloading the drive-in ram and the at least one drive spring.

2. Description of the Prior Art

In the drive-in tools of the type discussed above, a mechanical drive spring, which is preloaded by a tensioning device, is used as a drive source. An advantage of this consists in that a mechanical drive spring is economical so that a drive-in tool with such drive spring can be economically produced. Further, an advantage of a mechanical drive spring in comparison with a gas spring consists in that preloading of a mechanical spring does not lead to a temperature increases, as with a gas spring. Therefore, the preloaded mechanical spring does not lose the stored energy, whereas in the gas spring, the energy is gradually lost.

The drawback of a mechanical spring in comparison with a gas spring consists in that the mechanical spring creates an increased portion of the rebound of the drive-in tool during a setting process.

A drive-in tool of the type described above is disclosed in German Publication DE 40 13 022 A1. In the known drive-in tool, a spring drives an impact mechanism for driving a nail toward the drive-in tool muzzle. An adjusting device for returning the impact mechanism in the initial position includes an electric motor and gear transmission mechanism therefor. The rotation of the electric motor is transmitted via the gear transmission mechanism and a cooperating with it, toothed disc to the hammer body of the impact mechanism in order to displace the impact mechanism against a biasing force of the drive spring in the initial position of the impact mechanism in which the impact mechanism is ready for a further impact process.

The drawback of the known drive-in tool consists in that the maximal impact energy applied by the spring to the hammer body is between about 5-10 Joule and is rather low. Therefore, this drive-in tool is not suitable for driving fastening elements in hard constructional materials, such as steel and concrete. If the impact energy of the drive-in tool is to be increased, a stronger spring should be provided that can store more energy. However, with this, the spring mass is also increased, which in turn increases the rebound of the drive-in tool.

Accordingly, an object of the present invention is to provide a drive-in tool in which the foregoing drawbacks are eliminated, and the rebound is small even with the use of stronger drive springs.

SUMMARY OF THE INVENTION

This and other objects of the present invention, which will become apparent hereinafter, are achieved by providing, in a drive-in tool of the type discussed above, at least one second drive spring having a second expansion direction opposite the first expansion direction of the first drive spring. With the second drive spring, it is achieved that during a setting process, the masses of the first and second springs move in opposite directions so that the rebound accelerations of the drive springs at least partially compensate each other. The drive springs can be formed, e.g., as helical springs, leaf springs, disc springs, leg springs, or torsion springs.

Advantageously, the first drive spring and the second drive spring define, respectively, first and second spring axes extending coaxially with each other. Thereby, during the drive-in process, angular accelerations of the drive-in tool also can be prevented.

According to a constructively simple solution, the first drive spring and the second drive spring with respective first ends thereof engage, from opposite sides, a support element fixedly secured in the drive-in tool housing. The support element can be formed, e.g., as housing wall or housing web. Due to the mirror-symmetrical arrangement of the drive springs, their force vectors act exactly opposite each other, so that not only the rebound is equally compensated on both sides at correspondingly equal spring masses, but also no high load act on the stationary, with respect to the housing, support element.

Advantageously, the spring axes of the first and second drive springs extend parallel to an axis defined by the drive-in tool. This insures a compact construction.

Advantageously, mass of the second drive spring is at least as large as mass of the first drive spring. Thereby, the rebound accelerations of both drive springs are almost completely compensated.

It is advantageous when the second drive spring has a mass that corresponds to a combined mass of the drive-in ram and the first drive spring within a range +/−10%. This permits to almost completely compensate, with the second drive spring, not only rebound accelerations of the first drive spring but also rebound accelerations caused by the drive-in ram, within tolerances indicated above.

This is true for the present case where the expansion direction of the first drive spring corresponds to the drive-in direction of the drive-in ram.

Advantageously, the drive-in tool includes a drive device for connecting the first and second drive springs with each other and having its output side connected with the drive-in ram.

This permits to combine in a simple manner the displacement energy of both drive springs and transmit the combined energy to the drive-in ram. The drive device can be formed, e.g., as a cable drive. The drive device can, e.g., have a transmission ratio between the input movement and the output movement of about 1:4, whereby at a given expansion path of the drive spring, a stroke path of the drive-in ram, which is four times greater, is achieved.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
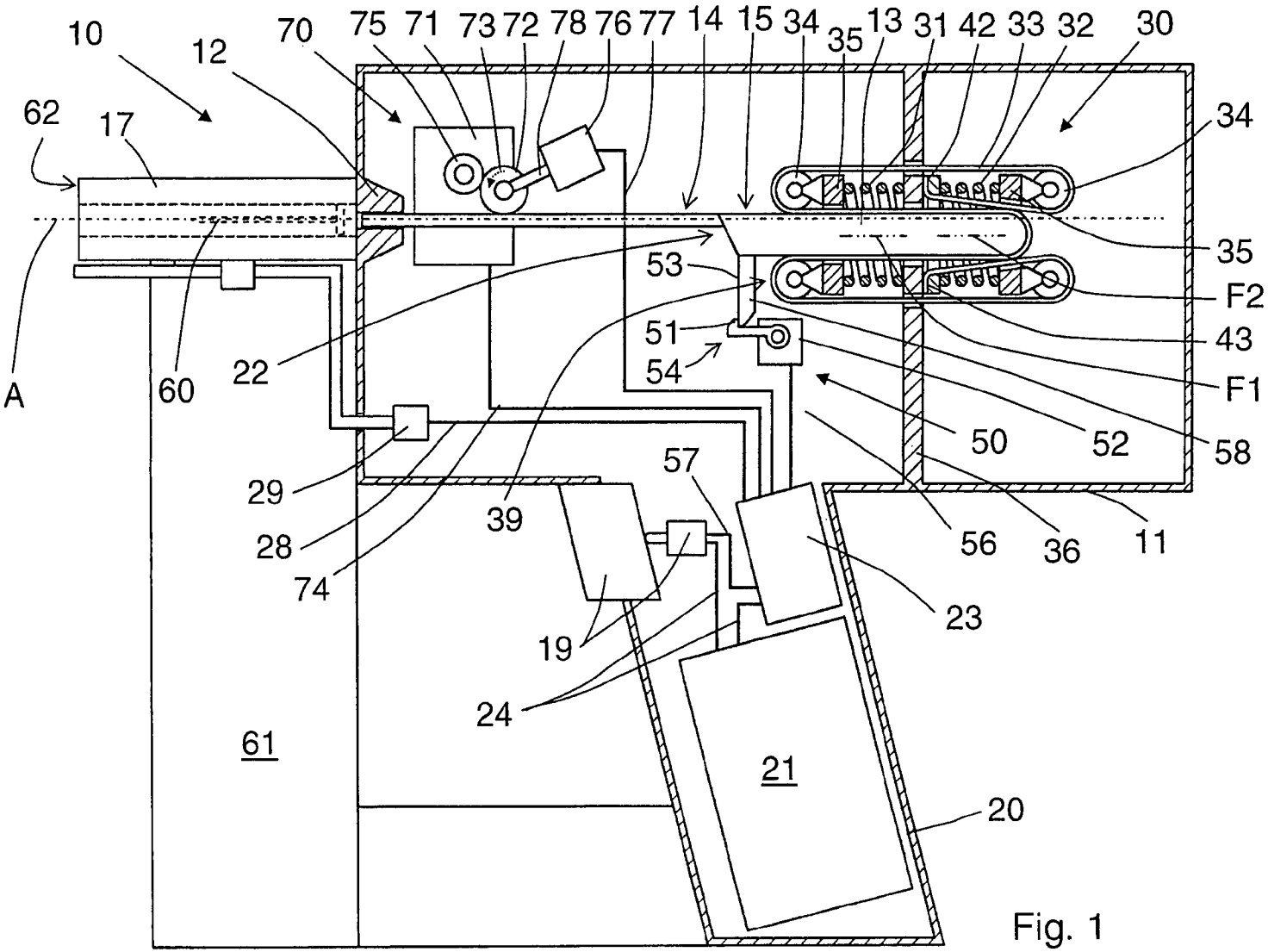
FIG. 1 a longitudinal cross-sectional of a hand-held drive-in tool cording to the present invention in its initial position.
Figure 2:
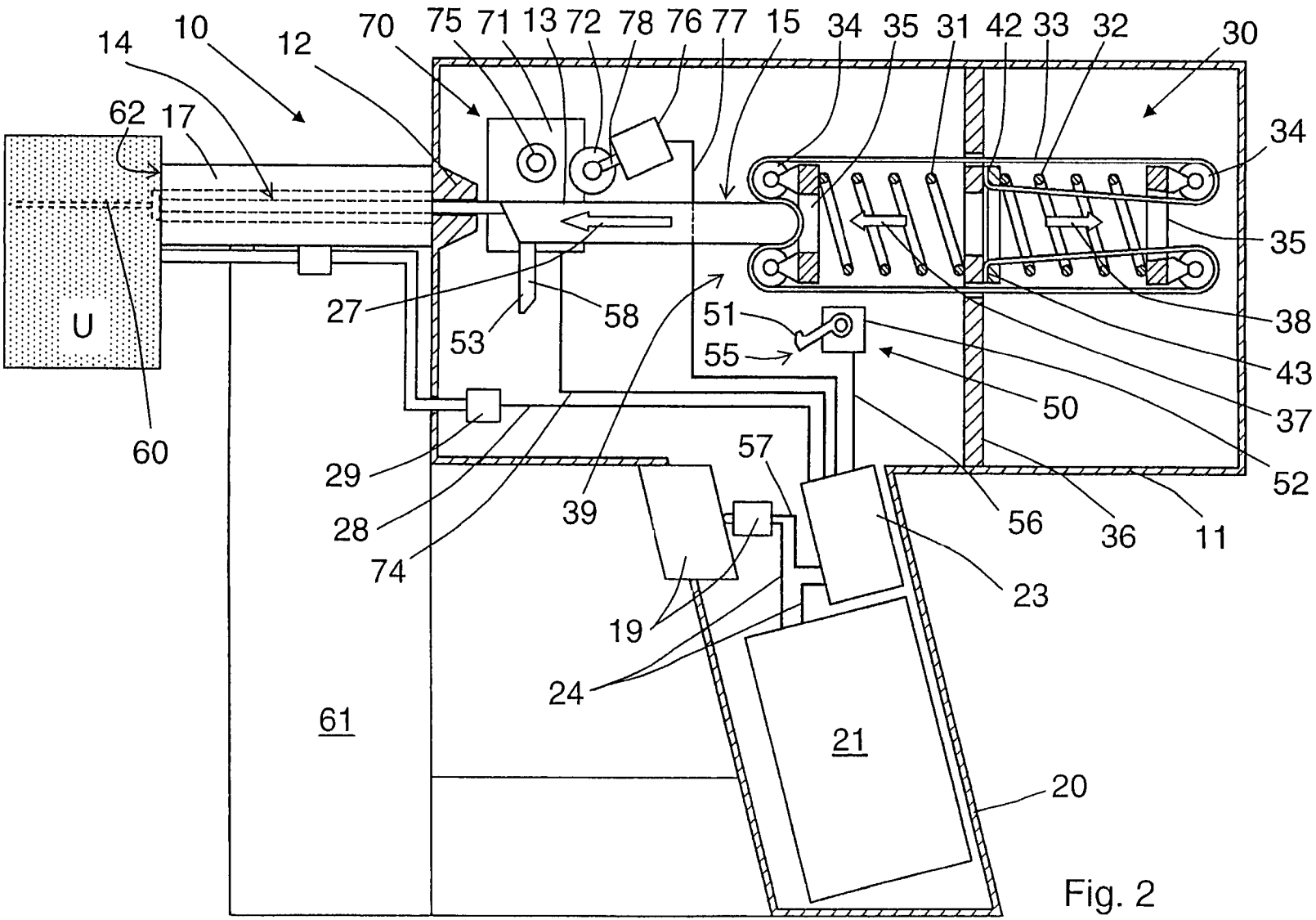
FIG. 2 a longitudinal cross-sectional of the tool shown in FIG. 1 its operational position.

A hand-held drive-in tool 10 according to the present invention, which is shown in FIGS. 1-2, has a housing 11 and a drive unit 30 which is generally designated with a reference numeral 30 and in located in the housing 11. The drive unit 30 is designed for displacing a drive-in ram 13 in a guide 12. The drive-in ram 13 has a drive-in section 14 and a head section 15. A bolt guide 17 adjoins an end of the guide 12 extending in a drive-in direction 27. The bolt guide 17 is arranged coaxially with the guide 12. A magazine 61 for fastening elements 60, in which the fastening element 60 are stored, projects sidewise of the bolt guide 17.

The drive unit 30 includes a first drive spring 31 and a second drive spring 32. Both springs 31, 32 have substantially the same spring mass and are supported against a support element 36, which is formed integrally with the housing 11 or is fixedly secured therein, opposite each other. Both springs 31, 32 are formed as helical springs. Drive springs 31, 32 define respective spring axes F1, F2 which are arranged coaxially in the drive unit 30 shown in the drawings. The spring axes F1, F2 extend parallel to an axis A defined by the drive-in ram 13. As particularly shown in FIG. 2, both drive springs 31, 32 have respective expansion directions 37, 38, extending opposite each other, i.e., upon expansion of the drive springs 31, 32, their respective ends, remote from the support element 36, move in opposite directions, so that during a drive-in process, their oppositely acting rebound accelerations compensate each other.

Both drive springs 31, 32 engage, via a drive device 39, the head section 15 of the drive-in ram 13. In the embodiment shown in FIGS. 1-2, the drive device 39 is formed as a cable drive. The first spring 31 and the second spring 32 are tensioned between the support element 36 and a respective spring take-off element 35. The ring-shaped spring take-off elements 35 carry, at their respective ends remote from the associated springs 31, 32, rollers 34 for a cable- or belt-shaped transmission means 33 of the drive device 39.

The cable- or belt-shaped transmission means 33, the first and second free ends 42, 43 of which are secured to the support element 36 secured to the housing 11, is displaced over the rollers 34 about the spring take-off elements 35. Simultaneously, the transmission means 33 is displaced about the free end of the head section 15 of the drive-in ram 13.

In an initial position 22 of the drive-in ram 13, which is shown in FIG. 1, the drive-in ram 13 is preloaded elastically by the drive device 39 and springs 31, 32 and has its head section 15, together with transmission means 33, extending through the openings of the spring take-off elements 35, the springs 31, 32, and the opening of the support element 36 which, as discussed above, is fixedly secured in the housing 11.

The drive-in ram 35 is held in its initial position 22 by a locking device generally designated with a reference numeral 50. The locking device 50 has a pawl 51 that engages, in a locking position 54 of the locking device 50 (see FIG. 1) a locking surface 53 on a projection 58 of the drive-in ram 13, retaining the drive in ram 13 against the biasing force of the spring 31. The pawl 51 is supported on a servo motor 52 that displaces it in a release position 55 shown in FIG. 2, as it would be explained further below. A first electrical conductor 56 connects the servo motor 52 with a control unit 23.

The drive-in tool 10 further has a handle 20 on which an actuation switch 19 for actuating a drive-in process with the drive-in tool 10 is arranged. A power supply, which is generally designated with a reference numeral 21 and which supplies the drive-in tool 10 with an electrical energy, is also located in the handle 24. Generally, the power source 21 has at least one accumulator. Electrical feeding conductors 24 connect the power source 21 with the control unit 23 and the actuation switch 19. The control unit 23 is connected with the actuation switch 19 by a switching conductor.

A switching element 29 is arranged on a muzzle 62 of the drive-in tool 10 and is connected with the control unit 23 by a switching conductor 28. The switching element 29 sends an electrical signal to the control unit 23 as soon as the drive-in tool 10 is pressed against a workpiece U, as shown in FIG. 2, insuring that the drive-in tool 10 can only then be actuated when it is properly pressed against the workpiece U.

On the drive-in tool 10, there is further provided a tensioning device generally designated with a reference numeral 70. The tensioning device 70 has a motor 71 that drives a drive roller 72. A second control conductor 74 connects the motor 71 with the control unit 23 that actuates the motor 71, e.g., when the drive-in ram 13 is located in its end, in the drive-in direction 27, position or when the drive-in tool 10 is lifted off the workpiece U. The motor 71 has an output element 75 such as a driven wheel connectable with the drive roller 72. To this end, the drive roller 72 is rotatably supported on a longitudinally adjustable adjusting arm 78 of an adjusting device 76 formed as solenoid. A servo conductor 77 connects the adjusting device 76 with the control unit 23. During an operation, the drive roller 72 rotates in a direction shown with dash arrow 73.

When the drive-in tool 10 is actuated by a main switch, not shown, the control unit 23 insures firstly that the drive-in ram 13 is in its initial position 22 shown in FIG. 1. If this is not the case, then the drive roller 72 is displaced by the adjusting device 76 toward the output element 75 already set in rotation by the motor 71, engaging the same. Simultaneously, the drive roller 72, which rotates in a direction shown with arrow 73, engages the drive-in ram 13, displacing the drive-in ram 13, in the direction of the drive device 30. As a result the drive spring 32 of the drive device 30 becomes preloaded. As soon as the drive-in ram 30 reaches its initial position 22, the pawl 51 of the locking device 50 engages the locking surface 53 of the projection 58 of the drive-in ram 13, retaining the drive-in ram in its initial position 22. Then, the motor 71 is turned off by the control unit 23, and the adjusting device 76, which is also controlled by the control unit 23, displaces the drive roller 72 from its engagement position with the output element 75 and the drive-in ram 13 to its disengagement position (see FIG. 2).

When the drive-in tool 10 is pressed against the workpiece U, as shown in FIG. 2, firstly, the switching means 29 puts the control unit 23 in a setting-ready position. When the actuation switch 19 is actuated by a user, the control unit 23 displaces the locking device in its release position 55, whereby the servo motor 52 lifts the pawl 51 off the locking surface 53 of the drive-in ram 13. The pawl 51 can be spring-biased in the direction of the drive-in ram 13 for automatically displacing the pawl 51 in its locking position 54.

Upon the pawl 51 being displaced in its release position 55, the drive device 39 and the drive springs 31, 32 of the drive unit 30 displace the drive-in ram 13 in the drive-in directions 27, whereby a fastening element 60 is driven in the workpiece U by the drive-in ram 13. The first drive spring 31 expands in the expansion direction 37 that corresponds to the drive-in direction of the drive-in ram 13. The second drive spring 32 expands in a precisely opposite direction, i.e., in the second expansion direction 38, whereby the rebound of both drive springs 31, 32 is self-compensated.

Advantageously, the expansion path of the drive springs 31, 32 is so converted by the drive device 39 that the acceleration path of the drive-in ram 13 is longer than the respective expansion path of the drive springs 31, 32. The conversion ratio of the drive device 39 amounts, in the embodiment shown in the drawings to about 1:4.

For returning the drive-in ram 13 and loading the drive springs 31, 32 at the end of a drive-in process, the tensioning device 70 is actuated by the control unit 23 when the drive-in tool 10 is lifted off the workpiece U. To this end, the switching means 29 generates an appropriate signal which is transmitted to the control unit 23. The tensioning device 70 displaces the drive-in ram 13 in the above-described manner against the drive springs 31, 32 of the drive unit 30, preloading the drive spring 31 anew, until the pawl 51 again is displaced into its locking position 54 in which it engages the locking surface 53 of the drive-in ram 13.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving fastening elements in a workpiece, comprising a guide (12); a drive-in ram (13) displaceable in the guide (12) for driving a fastening element in; a drive-in unit (30) for driving the drive-in ram (13) and including at least one first drive spring (31) and at least one second drive spring (32) simultaneously expandable, respectively, in a first expansion direction (37) and a second expansion direction (36) opposite the first expansion direction (37) for driving the drive-in ram in an operational direction of the drive-in ram (13) in which the drive-in ram (13) drives the fastening element in; and a tensioning device for preloading the first drive spring (31) and the second drive spring (32) of the drive unit (30).

2. A drive-in tool according to claim 1, wherein the first drive spring (31) and the second drive spring (32) define, respectively, first and second spring axes (F1, F2) extending coaxially with each other.

3. A drive-in tool according to claim 2, wherein the spring axes (F1, F2) of the first and second drive springs (31, 32) extend parallel to an axis (A) defined by the drive-in ram (13).

4. A drive-in tool according to claim 1, wherein the first drive spring (31) and the second drive spring (32) engage with respective first ends thereof, from opposite sides, a support element (36) fixedly secured in a drive-in tool housing (11).

5. A drive-in tool according to claim 1, wherein mass of the second drive spring (32) is at least as large as mass of the first drive spring (31).

6. A drive-in tool according to claim 5, wherein the second drive spring (32) has a mass that corresponds to a combined mass of the drive-in ram (13) and the first drive spring (31) within a range +/−10%.

7. A drive-in tool according to claim 1, comprising a drive device (39) for connecting the first and second drive springs (31, 32) with each other and having an output side thereof connected with the drive-in ram (13).

8. A drive-in tool according to claim 1, further comprising a locking device (50) having a locking position in which it retains the drive-in ram (13) in an initial position of the drive-in ram (13), and a release position in which it releases the drive-in ram (13).

9. A drive-in tool according to claim 8, wherein the drive-in ram (13) has a locking surface (53), and the locking device (50) includes a pawl (51) engaging the locking surface (53) of the drive-in ram (13) in the locking position of the locking device (50).

10. A drive-in tool according to claim 1, further comprising a support element (36) against which the at least one first drive spring (31) and at least one second drive spring (32) are supported, and wherein the drive-in ram (13) extends through the at least one first drive spring (31), the at least one second drive spring (32) and through an opening formed in the support element (36).

11. A drive-in tool according to claim 1, wherein the at least one first spring (31) and the at least one second spring (32) are arranged coaxially with each other, one after another, wherein the drive-in tool comprises a support element (36) arranged between the at least one first drive-spring (31) and the at least one first second drive spring (32), the at least one first drive spring (31) and the at least one second drive spring (32) being supported against the support element (36) at adjacent ends thereof, and two spring take-off elements (35) provided on opposite sides of the support element (36).

12. A drive-in tool according to claim 11, further comprising a drive device (39) for connecting the at least one first drive spring (31) and the at least one second drive spring (32) with the drive-in ram (13).

13. A drive-in tool according to claim 12, wherein the drive device (39) comprises rollers (34) carried by the spring take-off elements (35) on respective sides thereof remote from the at least one first drive spring (31) and the at least one second drive spring (32), and transmission means (33) displaceable around respective rollers (34).

* * * * *